US012025126B2

(12) United States Patent
Cho et al.

(10) Patent No.: US 12,025,126 B2
(45) Date of Patent: Jul. 2, 2024

(54) SCROLL COMPRESSOR AND HOME APPLIANCE INCLUDING THE SAME

(71) Applicant: Samsung Electronics Co., Ltd., Suwon-si (KR)

(72) Inventors: Sunghea Cho, Suwon-si (KR); Dohyun Kim, Suwon-si (KR); Jongcheun Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/985,372

(22) Filed: Nov. 11, 2022

(65) Prior Publication Data

US 2023/0193901 A1 Jun. 22, 2023

Related U.S. Application Data

(63) Continuation of application No. PCT/KR2022/017091, filed on Nov. 3, 2022.

(30) Foreign Application Priority Data

Dec. 16, 2021 (KR) ..... 10-2021-0181072

(51) Int. Cl.
*F03C 2/00* (2006.01)
*F01C 17/06* (2006.01)
(Continued)

(52) U.S. Cl.
CPC ..... *F04C 18/0215* (2013.01); *F01C 17/066* (2013.01); *F04C 23/008* (2013.01); *F04C 2240/50* (2013.01)

(58) Field of Classification Search
CPC ..... F04C 18/0215; F04C 23/008; F04C 2240/50; F01C 17/06; F01C 17/066
See application file for complete search history.

(56) References Cited

U.S. PATENT DOCUMENTS 4,545,747 A * 10/1985 Tamura ..... F04C 18/0215 418/55.1
8,303,280 B2 11/2012 Kiyokawa et al.
(Continued)

FOREIGN PATENT DOCUMENTS

JP 61-175201 8/1986
JP 10-122165 5/1998
(Continued)

OTHER PUBLICATIONS

WO-0238960-A1—Konishi et al.—Scroll Fluid Machine—May 16, 2022—the English Machine Translation. (Year: 2002).*
(Continued)

*Primary Examiner* — Theresa Trieu
(74) *Attorney, Agent, or Firm* — STAAS & HALSEY LLP

(57) ABSTRACT

A scroll compressor including a fixed scroll including a fixed wrap, an orbiting scroll including an orbiting wrap facing the fixed scroll to form a compression chamber together with the fixed wrap, and a first receiving groove formed on a second surface, opposite to the orbiting wrap, a frame including a second receiving groove formed on a surface facing the second surface of the orbiting scroll and forming a ring-shaped chamber disposed inside the frame and between the second surface and the surface of the frame, a guide ring disposed in the ring-shaped chamber, and a plurality of roller bearings each including an inner ring fixed to the guide ring, wherein some of the roller bearings are disposed in the first receiving groove and others are disposed in the second receiving groove, and the guide ring and the plurality of roller bearings prevent the orbiting scroll from rotating.

18 Claims, 6 Drawing Sheets

(51) Int. Cl.

| | |
|---|---|
| ***F03C 4/00*** | (2006.01) |
| ***F04C 2/00*** | (2006.01) |
| ***F04C 18/00*** | (2006.01) |
| ***F04C 18/02*** | (2006.01) |
| *F04C 23/00* | (2006.01) |

(56) References Cited

U.S. PATENT DOCUMENTS

| | | | |
|---|---|---|---|
| 9,322,273 | B2 | 4/2016 | Earmme et al. |
| 11,242,854 | B2 | 2/2022 | Kim et al. |
| 2001/0033801 | A1 | 10/2001 | Takahashi |
| 2010/0050122 | A1 | 2/2010 | Nakajima |
| 2011/0300013 | A1 | 12/2011 | Hwang et al. |
| 2018/0066700 | A1 | 3/2018 | Kozuma et al. |

FOREIGN PATENT DOCUMENTS

| | | | | |
|---|---|---|---|---|
| JP | 2000-161250 | | 6/2000 | |
| JP | 2002317777 | A * | 10/2002 | ..... F01C 17/063 |
| JP | 2003-83267 | | 3/2003 | |
| JP | 2004-124735 | | 4/2004 | |
| JP | 3956586 | | 8/2007 | |
| JP | 2020-112062 | | 7/2020 | |
| KR | 0115173 | | 3/1994 | |
| KR | 94-21935 | | 10/1994 | |
| KR | 10-1995-0019217 | | 7/1995 | |
| KR | 10-0208095 | | 7/1999 | |
| KR | 10-0208098 | | 7/1999 | |
| KR | 10-0235857 | | 12/1999 | |
| KR | 2000-0001772 | | 1/2000 | |
| KR | 2001-0098641 | | 11/2001 | |
| KR | 2002-0023514 | | 3/2002 | |
| KR | 10-0696129 | | 3/2007 | |
| KR | 10-1043249 | | 6/2011 | |
| KR | 10-2012-0004395 | | 1/2012 | |
| KR | 10-1164320 | | 7/2012 | |
| KR | 10-1216466 | | 12/2012 | |
| KR | 10-2013-0143325 | | 12/2013 | |
| KR | 10-2019-0139058 | | 12/2019 | |
| KR | 10-2020-0030390 | | 3/2020 | |
| KR | 10-2021-0015143 | | 2/2021 | |
| KR | 10-2239329 | | 4/2021 | |
| WO | WO-0238960 | A1 * | 5/2002 | ..... F01C 17/063 |

OTHER PUBLICATIONS

JP-2002317777-A Konishi et al.—Scroll Fluid Machine—Oct. 31, 2022—the English Machine Translation. (Year: 2002).*

International Search Report, PCT/ISA/210, dated Feb. 17, 2023, in PCT Application No. PCT/KR2022/017091.

Written Opinion, PCT/ISA/237, dated Feb. 17, 2023, in PCT Application No. PCT/KR2022/017091.

* cited by examiner

SCROLL COMPRESSOR AND HOME APPLIANCE INCLUDING THE SAME

CROSS-REFERENCE TO RELATED APPLICATION(S)

This application a continuation application of PCT International Patent Application No. PCT/KR2022/017091, filed Nov. 3, 2022 which is based on and claims priority under 35 U.S.C. § 119 to Korean Patent Application No. 10-2021-0181072, filed on Dec. 16, 2021 in the Korean Intellectual Property Office, the disclosure of which is incorporated by reference herein in its entirety.

BACKGROUND

Field

Apparatuses and methods consistent with the disclosure relate to a scroll compressor in which a friction loss is reduced by connecting a bearing member to a guide member for preventing an orbiting scroll from rotating, and a home appliance including the same.

Description of Related Art

A scroll compressor is a device for compressing a refrigerant by meshing a fixed scroll and an orbiting scroll each having a spiral wrap and rotating the orbiting scroll with respect to the fixed scroll.

The scroll compressor has a plurality of compression pockets that are formed by the fixed scroll fixed within a sealed housing and the orbiting scroll orbiting opposite to the fixed scroll. The plurality of compression pockets are gradually narrowed from an outer periphery toward a center of the fixed scroll by an orbiting motion of the orbiting scroll. The refrigerant is sucked into the compression pocket located on the outer periphery, and compressed while the compression pocket moves toward the center by the rotation of the orbiting scroll, and the maximally compressed refrigerant is discharged from the compression pocket into the sealed housing when the compression pocket is located at the center.

The scroll compressor includes a guide member disposed between the orbiting scroll and a frame to prevent the orbiting scroll from rotating. However, when the orbiting scroll rotates, as the guide member relatively moves with respect to the orbiting scroll and the frame while being in surface contact with the orbiting scroll and the frame, there is a problem in that a large friction loss occurs.

SUMMARY

According to an embodiment of the disclosure, a scroll compressor may include: a housing; a fixed scroll fixed to an inside of the housing and including a fixed wrap; an orbiting scroll including an orbiting wrap disposed on a first surface of the orbiting scroll facing the fixed scroll to form a compression chamber together with the fixed wrap, and a first receiving groove formed on a second surface, opposite to the first surface, of the orbiting scroll; a frame fixed to the inside of the housing and including a second receiving groove formed on a surface of the frame facing the second surface of the orbiting scroll; a guide member between the orbiting scroll and the frame to prevent the orbiting scroll from rotating; and a plurality of bearing members some of which are disposed in the first receiving groove and others of which are disposed in the second receiving groove, and each bearing member of the plurality of bearing members incudes an inner ring fixed o the guide member.

The scroll compressor may further include a plurality of pin members corresponding, respectively, to the plurality of bearing members, wherein one end of each pin member of the plurality of pin members is fixed to the guide member and the other end of the pin member is fixed to the inner ring of the corresponding bearing member of the plurality of bearing members.

The guide member may include a plurality of insertion holes formed at locations corresponding, respectively, to the plurality of bearing members, and the one end of each pin member of the plurality of pin members is inserted into the insertion hole of the plurality of insertion holes that corresponds to the bearing member of the plurality of bearing members to which the pin member corresponds.

The inner ring of each bearing member of the plurality of bearing members may surround the other end of the pin member that corresponds to the bearing member.

The plurality of bearing members may include a first bearing member disposed in the first receiving groove and including an outer ring spaced apart from a surface of the guide member facing the orbiting scroll; and a second bearing member disposed in the second receiving groove and including an outer ring spaced apart from a surface of the guide member facing the frame.

The first bearing member may include a pair of first bearing members disposed on a first line extending along a radial direction of the guide member, and the second bearing member may include a pair of second bearing members extending along a radial direction of the guide member and disposed on a second line orthogonal to the first line.

Each first bearing member of the pair of first bearing members may be located at the same distance from a center of the guide member, and each second bearing member of the pair of second bearing members may be located at the same distance from the center of the guide member.

The outer ring of the first bearing member may be in contact with an inner surface of the first receiving groove, and the outer ring of the second bearing member may be in contact with an inner surface of the second receiving groove.

The first receiving groove may extend in a radial direction of the orbiting scroll, and the second receiving groove may extend in a radial direction of the frame.

Each bearing member of the plurality of bearing members may include an outer ring, one end of the first receiving groove may have a curved shape engaged with the outer ring of each bearing member of the bearing members disposed in the first receiving groove, and one end of the second receiving groove may have a curved shape engaged with the outer ring of each bearing member of the bearing members disposed in the second receiving groove.

Each bearing member of the plurality of bearing members may include an outer ring and a plurality of rolling members disposed between the outer ring and the inner ring of the bearing member.

Each bearing member of the bearing members disposed in the first receiving groove may include an outer ring having a diameter smaller than or equal to a width of the first receiving groove, and each bearing member of the bearing members disposed in the second receiving groove may include an outer ring having a diameter smaller than or equal to a width of the second receiving groove.

The frame may include an outer wall to which the fixed scroll is fixed, an inner wall supporting the orbiting scroll and surrounded by the guide member, and a concave recess between the outer wall and the inner wall, and the inner wall of the frame may include a groove formed by extending the second receiving groove.

According to another embodiment of the disclosure, a home appliance that controls temperature through heat exchange using a refrigerant may include a scroll compressor configured to compress the refrigerant, in which the scroll compressor may include a housing; a fixed scroll fixed to an inside of the housing and include a fixed wrap; an orbiting scroll including an orbiting wrap disposed on a first surface of the orbiting scroll facing the fixed scroll to form a compression chamber together with the fixed wrap, and a first receiving groove formed on a second surface, opposite to the first surface, of the orbiting scroll; a frame fixed to the inside of the housing and including a second receiving groove formed on a surface of the frame facing the second surface of the orbiting scroll; a guide member disposed between the orbiting scroll and the frame to prevent the orbiting scroll from rotating; at least one bearing member disposed in the first receiving groove and including an inner ring fixed to the guide member, and at least one bearing member disposed in the second receiving groove and including an inner ring fixed o the guide member.

The home appliance may be one of an air conditioner, a refrigerator, and a freezer.

According to another embodiment of the disclosure, a scroll compressor may include a housing; a fixed scroll fixed to an inside of the housing and including a fixed wrap; an orbiting scroll including an orbiting wrap disposed on a first surface of the orbiting scroll facing the fixed scroll to form a compression chamber together with the fixed wrap, and a first receiving groove formed on a second surface, opposite to the first surface, of the orbiting scroll; a frame fixed to the inside of the housing and including a second receiving groove formed on a surface of the frame facing the second surface of the orbiting scroll; a guide member between the orbiting scroll and the frame to prevent the orbiting scroll from rotating; a bearing member disposed in the first receiving groove and including an inner ring fixed to the guide member; and a bearing member disposed in the second receiving groove and including an inner ring fixed to the guide member.

The scroll compressor may further include a first pin member having one end fixed to the guide member and another end fixed to the inner ring of the bearing member disposed in the first receiving groove, and a second pin member having one end fixed to the guide member and another end fixed to the inner ring of the bearing member disposed in the second receiving groove.

The inner ring of the bearing member disposed in the first receiving groove may surround the another end of the first pin member, and the inner ring of the bearing member disposed in the second receiving groove may surround the another end of the second pin member.

The guide member may include first insertion hole formed at a location corresponding to the bearing member disposed in the first receiving groove, and a second insertion hole formed at a location corresponding the bearing disposed in the second receiving groove, and the one end of the first pin member may be inserted into the first insertion hole, and the one end of the second pin member may be inserted into the second insertion hole.

Additional and/or other aspects and advantages of the disclosure will be set forth in part in the description which follows and, in part, will be obvious from the description, or may be learned by practice of the disclosure.

BRIEF DESCRIPTION OF THE DRAWINGS

The above and/or other aspects of the disclosure will be more apparent by describing certain embodiments of the disclosure with reference to the accompanying drawings, in which.

DETAILED DESCRIPTION

Embodiments described below are illustratively provided to assist in understanding of the present disclosure, and it is to be understood that the present disclosure may be variously modified and executed unlike exemplary embodiments described herein. However, when it is decided that a detailed description for the known functions or components related to the present disclosure may obscure the gist of the present disclosure, the detailed description and concrete illustration will be omitted. Further, the accompanying drawings are not illustrated to scale, but sizes of some of components may be exaggerated to assist in the understanding of the present disclosure.

Terms used in the present specification and claims are selected from general terms in consideration of the functions of the present disclosure. However, these terms may vary depending on an intention of a person skilled in the art, a legal or technical interpretation, and an appearance of new technologies, and the like. Also, some terms are arbitrarily selected by the applicant. These terms may be interpreted as meanings defined in the present specification, and may be interpreted based on the general contents of the present specification and common technical knowledge in the art as long as terms are specifically defined.

In the present disclosure, an expression "have", "may have", "include", "may include", or the like, indicates existence of a corresponding feature (for example, a numerical value, a function, an operation, a component such as a part, or the like), and does not exclude existence of an additional feature.

In addition, since the present specification describes components necessary for the description of each embodiment of the present disclosure, the present disclosure is not necessarily limited thereto. Accordingly, some components may be changed or omitted, and other components may be added. In addition, these components may be distributed and arranged in different independent devices.

Furthermore, embodiments of the present disclosure will be described in detail with reference to the accompanying drawings and the contents described in the accompanying drawings, but the present disclosure is not limited or limited by the embodiments.

Hereinafter, the present disclosure will be described in more detail with reference to the drawings.

The present disclosure provides a scroll compressor in which a friction loss is reduced by connecting a bearing member to a guide member for preventing an orbiting scroll from rotating, and a home appliance including the same.

Figure 1:
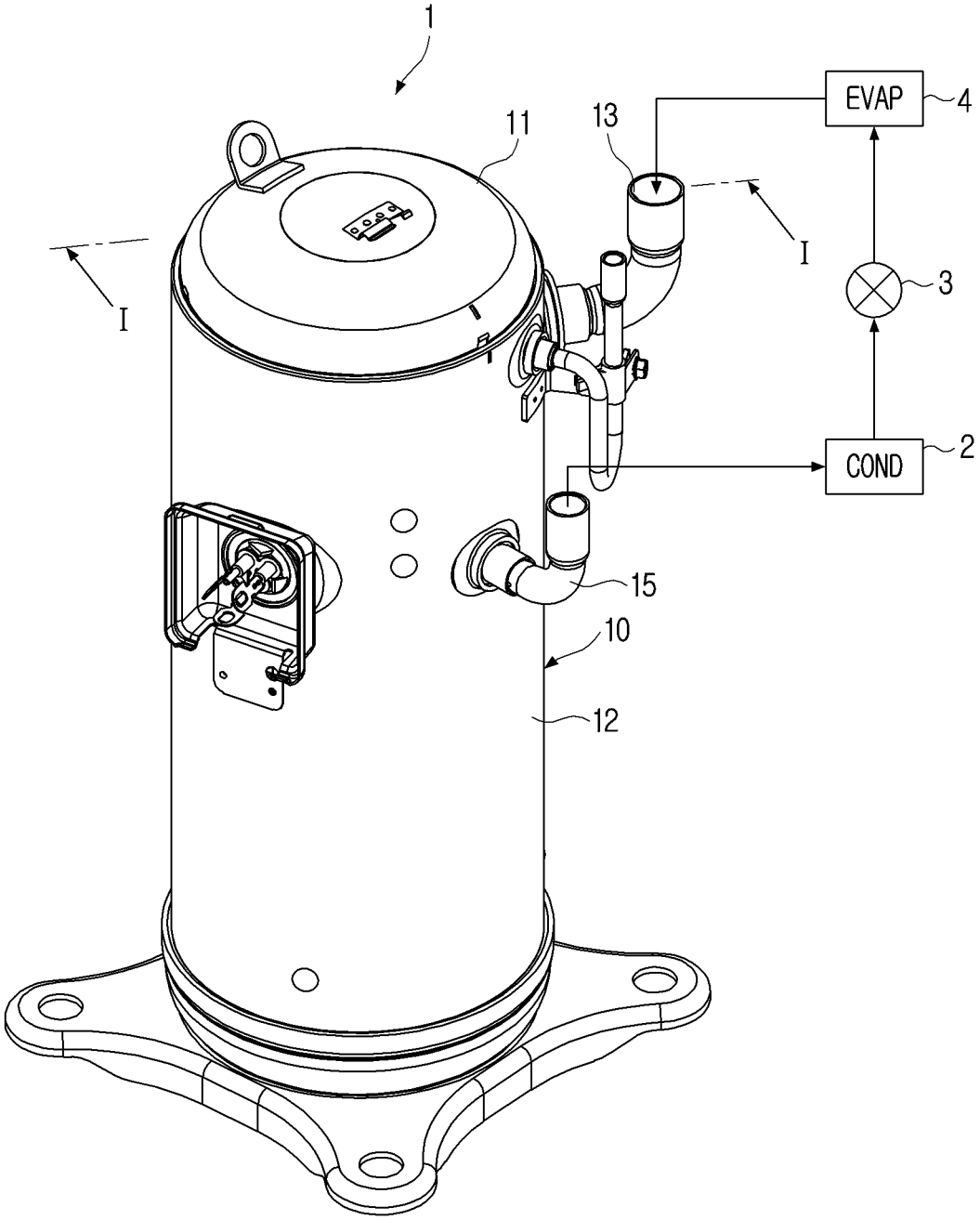
FIG. 1 is a perspective view of a scroll compressor according to an embodiment of the present disclosure.
Figure 2:
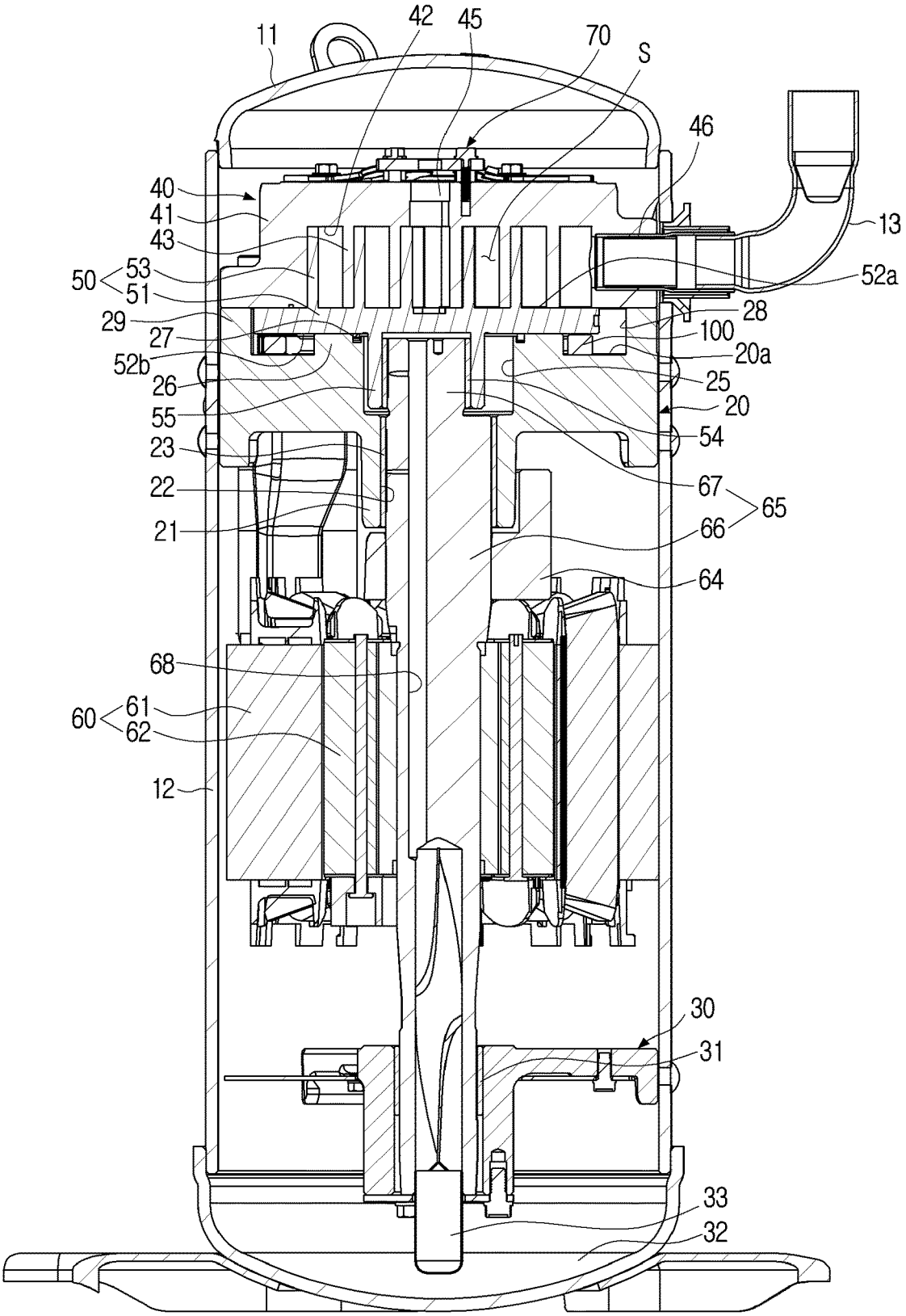
FIG. 2 is a cross-sectional view of the scroll compressor of FIG. 1 taken along line I-I.

FIG. 1 is a perspective view of a scroll compressor according to an embodiment of the present disclosure. FIG. 2 is a cross-sectional view of the scroll compressor of FIG. 1 taken along line I-I.

As illustrated in FIG. 1, a refrigeration cycle has four strokes of compression, condensation, expansion, and evaporation, and the four strokes of the compression, condensation, expansion, and evaporation may be generated by allowing a refrigerant to circulate a rotary compressor 1, a condenser 2, an expansion valve 3, and an evaporator 4.

The rotary compressor 1 compresses and discharges a refrigerant gas in a high-temperature and high-pressure state, and the high-temperature and high-pressure refrigerant gas discharged from the rotary compressor 1 may be introduced into the condenser 2.

In the condenser 2, the refrigerant compressed in the compressor 1 is condensed into a liquid phase, and heat may be discharged to the surroundings through a condensation process.

The expansion valve 3 expands the refrigerant in the high temperature and high pressure state condensed in the condenser 2 into a refrigerant in a low temperature and low pressure state, and the evaporator 4 serves to achieve a refrigeration effect by heat exchange with an object to be cooled by using latent heat of evaporation while evaporating the refrigerant expanded in the expansion valve 3, and at the same time, serves to return a refrigerant gas in a low-temperature and low-pressure state to the rotary compressor 1 by evaporating the expanded refrigerant. Through the cycle, the air temperature in the indoor space may be controlled.

The home appliance having such a cooling cycle may be one of an air conditioner, a refrigerator, and a freezer. However, the present disclosure is not limited thereto and may be used in various home appliances having a cooling cycle. The rotary compressor 1 according to the embodiment of the present disclosure may be used in various devices including the compressor as well as the above-described home appliance.

Referring to FIGS. 1 and 2, a scroll compressor 1 according to the embodiment of the present disclosure may include a housing 10, a frame 20, a sub-frame 30, a fixed scroll 40, an orbiting scroll 50, a driving motor 60, and a check valve 70.

The housing 10 is a sealed container having a cylindrical shape, and may include an upper housing 11 and a lower housing 12. The frame 20, the sub-frame 30, the fixed scroll 40, the orbiting scroll 50, the driving motor 60, and the check valve 70 may be received in the housing 10.

A refrigerant inlet pipe 13 through which a refrigerant is introduced and a refrigerant outlet pipe 15 through which a refrigerant is discharged may be installed on an outer surface of the housing 10. The refrigerant inlet pipe 13 passes through the housing 10, and one end thereof may be connected to the fixed scroll 40. The refrigerant outlet pipe 15 passes through the housing 10, and one end thereof may communicate with the inside of the housing 10. Accordingly, the refrigerant may be introduced into the fixed scroll 40 installed in the housing 10 through the refrigerant inlet pipe 13, and may be discharged to the outside of the housing 10 through the refrigerant outlet pipe 15.

The frame 20 and the sub-frame 30 are disposed to be spaced apart from each other at a predetermined interval up and down inside the housing 10, and each may be fixed to the inner surface of the housing 10, respectively. A driving motor 60 may be rotatably installed between the frame 20 and the sub-frame 30.

The fixed scroll 40 and the orbiting scroll 50 may be disposed above the frame 20. An oil storage tank 32 in which oil or lubricating oil for lubricating and cooling components received in the housing 10 is stored may be provided below the sub-frame 30 in the lower portion of the housing 10.

The frame 20 is formed in a substantially circular plate shape, and may include a protrusion 21 formed on a lower surface of the frame 20. A shaft support hole 22 may be formed in the protrusion 21 of the frame 20, and a bearing metal 23 for supporting the rotating shaft may be installed in the shaft support hole 22. Since a rotation shaft 65 is inserted to penetrate through the bearing metal 23, the bearing metal 23 may support the rotation of the rotation shaft 65.

In the frame 20, a boss insertion groove 25 having an inner diameter greater than that of the shaft support hole 22 may be provided above the shaft support hole 22. The boss insertion groove 25 may communicate with the shaft support hole 22.

The frame 20 may include an inner wall 26 forming an upper end of the boss insertion groove 25 provided on an upper surface thereof. The inner wall 26 may have a ring shape that protrudes upward from the upper surface of the frame 20 and surrounds the boss insertion groove 25.

An upper surface of the inner wall 26 may be formed as a mirror surface to contact and support the orbiting scroll 50. In addition, an oil ring 27 may be installed on the upper surface of the inner wall 26 to surround the boss insertion groove 25.

The frame 20 may include a ring-shaped recess 28 disposed on the outside of the inner wall 26. The recess 28 may form a back pressure chamber together with the orbiting scroll 50. The back pressure chamber may be filled with oil supplied from the oil storage tank 32.

In addition, a guide member 100 for preventing the orbiting scroll 50 from rotating may be installed in the back pressure chamber between the orbiting scroll 50 and the frame 20. The guide member 100 may be implemented as an oldham ring.

The fixed scroll 40 is installed above the frame 20, and the orbiting scroll 50 may be received in a space formed by the fixed scroll 40 and the frame 20. The orbiting scroll 50 is engaged with the fixed scroll 40, and may be installed between the fixed scroll 40 and the frame 20 to orbit with respect to the fixed scroll 40.

The fixed scroll 40 may include a body part 41 and a fixed wrap 43. The body part 41 is formed in a shape corresponding to the inner surface of the housing 10, and a fixed mirror surface 42 is formed on a surface facing the orbiting scroll 50. The fixed wrap 43 extends vertically from the fixed mirror surface 42 of the body part 41 and may be formed as a curved surface having a predetermined thickness and height. An outlet 45 through which a refrigerant compressed by the fixed scroll 40 and the orbiting scroll 50 is discharged may be provided on an upper surface of the body part 41, and an inlet 46 through which a refrigerant is introduced may be provided at a side surface of the body part 41. The inlet 46 may be connected to the refrigerant inlet pipe 13 installed in the housing 10. Accordingly, the refrigerant introduced through the refrigerant inlet pipe 13 may be introduced into the inside of the fixed scroll 40 through the inlet 46.

The orbiting scroll 50 may include an orbiting plate 51, an orbiting wrap 53, and a boss part 55. The orbiting plate 51 may be formed in a disk shape having a predetermined thickness and area, and one surface 52*a* facing the fixed scroll 40 may be formed as a mirror surface. The orbiting wrap 53 extends vertically from one surface 52*a* of the orbiting plate 51 and may be formed as a curved surface having a predetermined thickness and height. For example, the orbiting wrap 53 may be formed as a curved surface in which an inner curve forming the inner surface of the orbiting wrap 53 and an outer curve forming the outer surface of the orbiting wrap 53 are formed as an involute curve, a hybrid curve, etc. The orbiting wrap 53 may be formed to mesh with the fixed wrap 43 of the fixed scroll 40. The boss part 55 may be formed in a center of the other surface 52*b* of the orbiting scroll 50. An eccentric part 67 formed at an upper end of the rotation shaft 65 may be inserted into the boss part 55.

The orbiting wrap 53 of the orbiting scroll 50 may be engaged with the fixed wrap 43 of the fixed scroll 40, and the boss part 55 may be inserted into the boss insertion groove 25 of the frame 20. In addition, the other surface 52*b* of the orbiting scroll 50 on which the boss part 55 is formed may be supported by the inner wall 26 of the frame 20. Accordingly, one surface of the orbiting plate 51 supported by the inner wall 26 of the frame 20 may also be formed as a mirror surface.

A plurality of compression pockets may be formed between the fixed wrap 43 of the fixed scroll 40 and the rotating wrap 53 of the fixed scroll 50 in a state in which the rotating wrap 53 of the fixed scroll 50 is engaged with the fixed wrap 43 of the fixed scroll 40. A plurality of compression pockets may be a compression chamber S that compresses the refrigerant introduced into the inlet 46 of the fixed scroll 40.

The driving motor 60 may include a stator 61 and a rotor 62. The stator 61 may be fixed to the inner surface of the housing 10. The rotor 62 may be rotatably inserted inside the stator 61. Also, the rotor 62 may be inserted through the rotation shaft 65. The rotation shaft 65 is fixed to the rotor 62, and may rotate integrally with the rotor 62.

The rotation shaft 65 may include a shaft part 66 formed to have a predetermined length and an eccentric part 67 formed to extend upwardly from one end of the shaft part 66.

The rotor 62 of the driving motor 60 may be fixed to the shaft part 66 of the rotation shaft 65. One end of the shaft part 66 is inserted into the protrusion 21 of the frame 20, and may be supported by the bearing metal 23 installed on the protrusion 21.

The eccentric part 67 of the rotation shaft 65 may be inserted into the boss part 55 of the orbiting scroll 50. A bearing metal 54 may also be installed between the eccentric part 67 of the rotation shaft 65 and the boss part 55 of the orbiting scroll 50.

A balance weight 64 may be installed above the rotor 62 on the shaft part 66 of the rotation shaft 65. A lower portion of the shaft part 66 may be supported by a bearing metal 31 installed on the sub-frame 30.

In addition, the rotation shaft 65 may include an oil passage 68 formed to penetrate through the shaft part 66 and the eccentric part 67. An oil supply device 33 for supplying oil from the oil storage tank 32 to the oil passage 68 may be installed at a lower end of the rotation shaft 65.

One end of the oil supply device 33 may be submerged in the oil storage tank 32 of the housing 10. Accordingly, when the rotation shaft 65 rotates, the oil stored in the oil storage tank 32 by the pressure acting on the oil storage tank 32 and the oil supply device 33 may be supplied to the oil passage 68 of the rotation shaft 65. The oil supplied to the oil passage 68 may be supplied to the boss part 55 of the orbiting scroll 50 and the bearing metal 23 of the frame 20.

The check valve 70 may be installed on an upper surface of the fixed scroll 40 to selectively open and close the outlet 45. The check valve 70 may be installed in a discharge area of the fixed scroll 40. For example, when a radius of the upper surface of the fixed scroll 40 is R, the check valve 70 may be installed to open and close the outlet 45 provided inside a virtual circle having a radius of 0.3R from the center of the fixed scroll 40.

Hereinafter, the guide member 100 of the scroll compressor 1 according to the embodiment of the present disclosure will be described in detail with reference to FIGS. 3 to 6.

Figure 3:
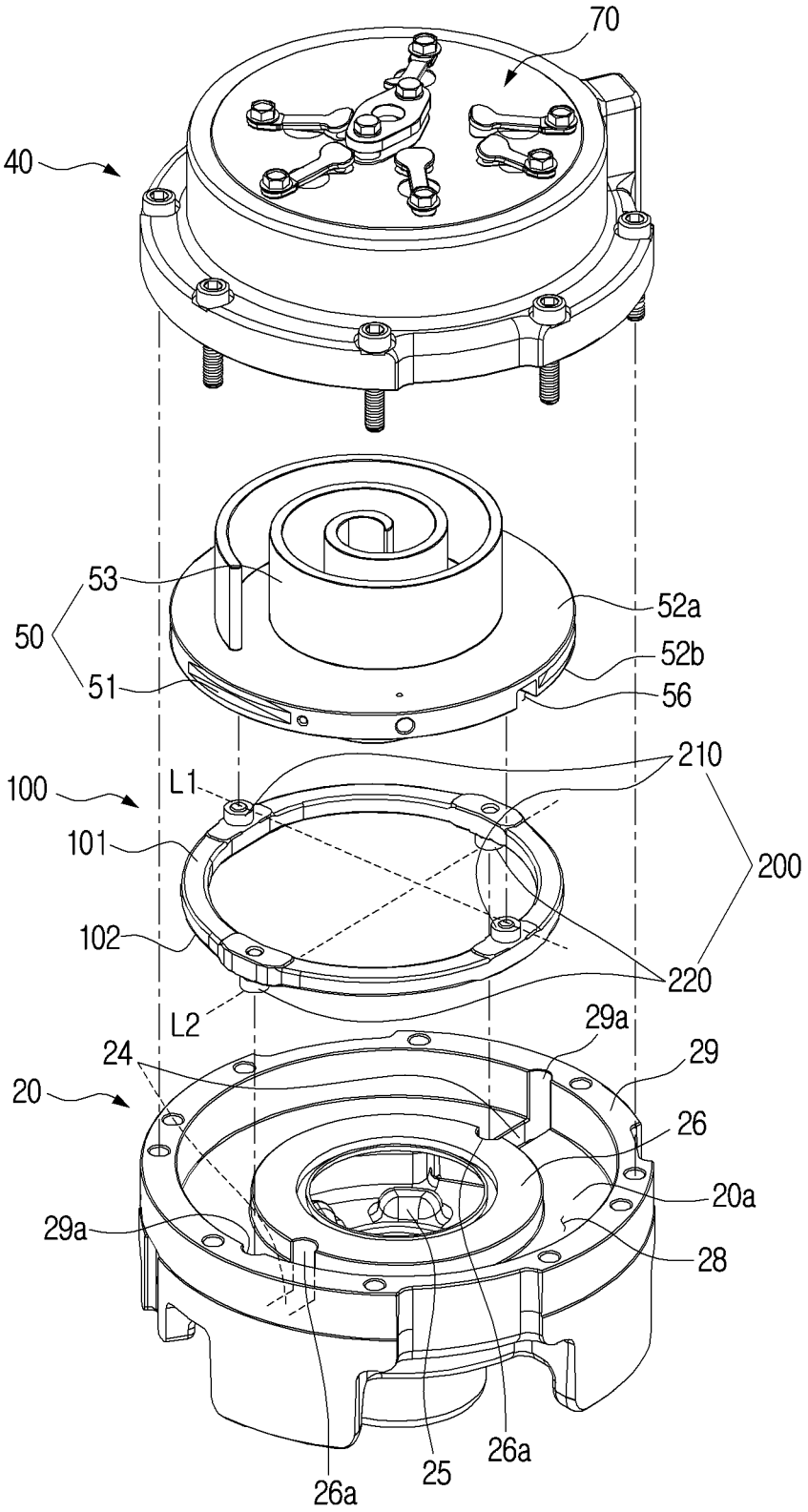
FIG. 3 is an exploded perspective view illustrating a structure in which a bearing member is disposed in a receiving groove of a frame.
Figure 4:
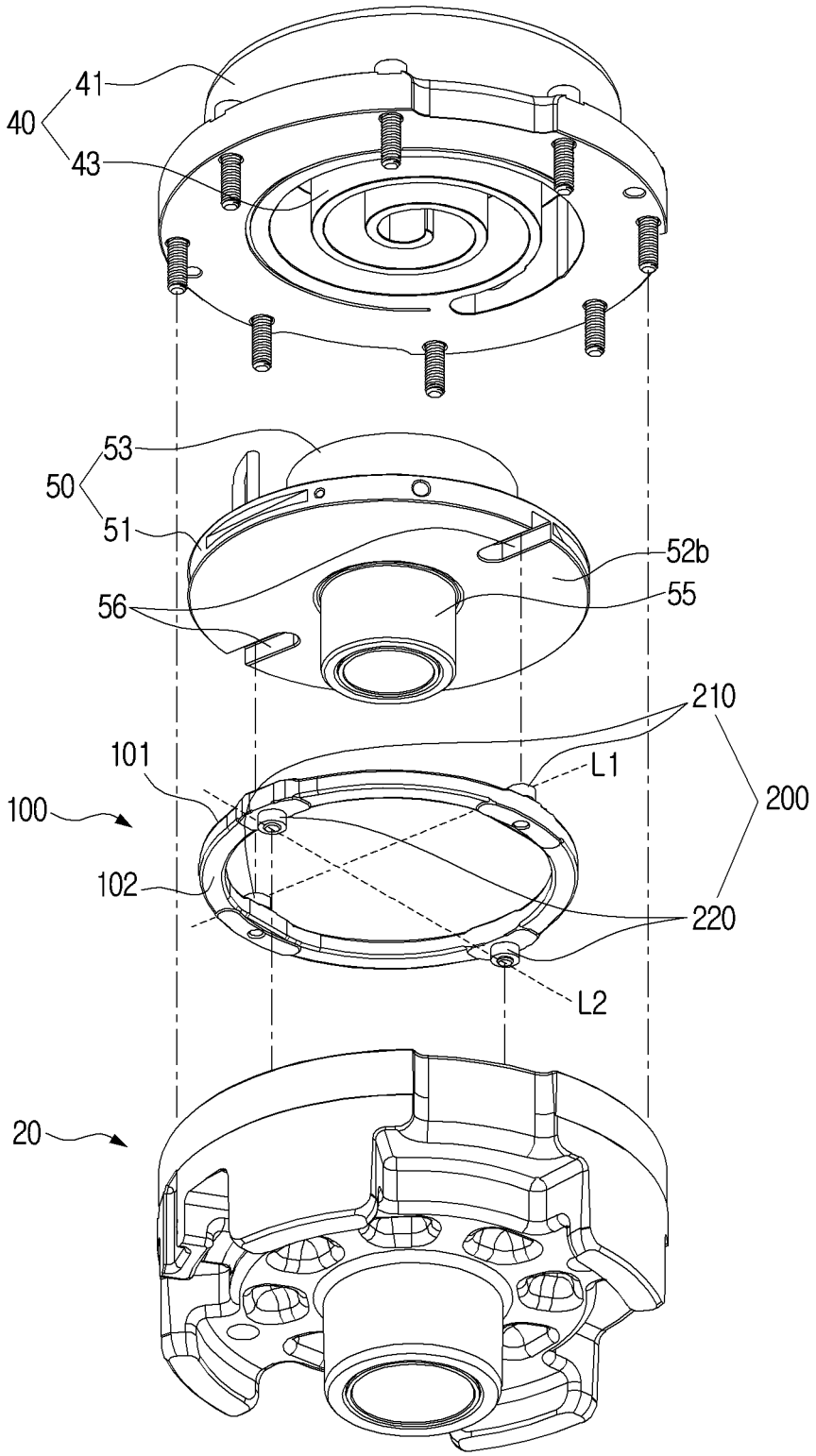
FIG. 4 is an exploded perspective view for describing a structure in which the bearing member is disposed in the receiving groove of the orbiting scroll.
Figure 5:
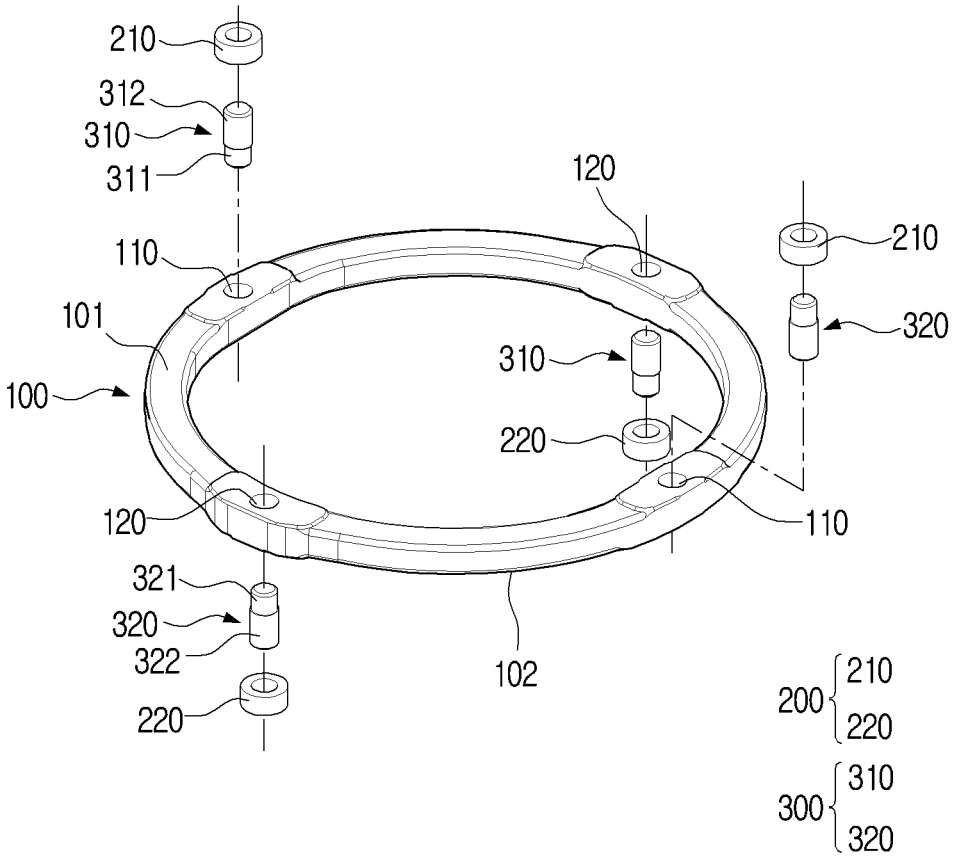
FIG. 5 is an exploded perspective view of a guide member and the bearing member.
Figure 6:
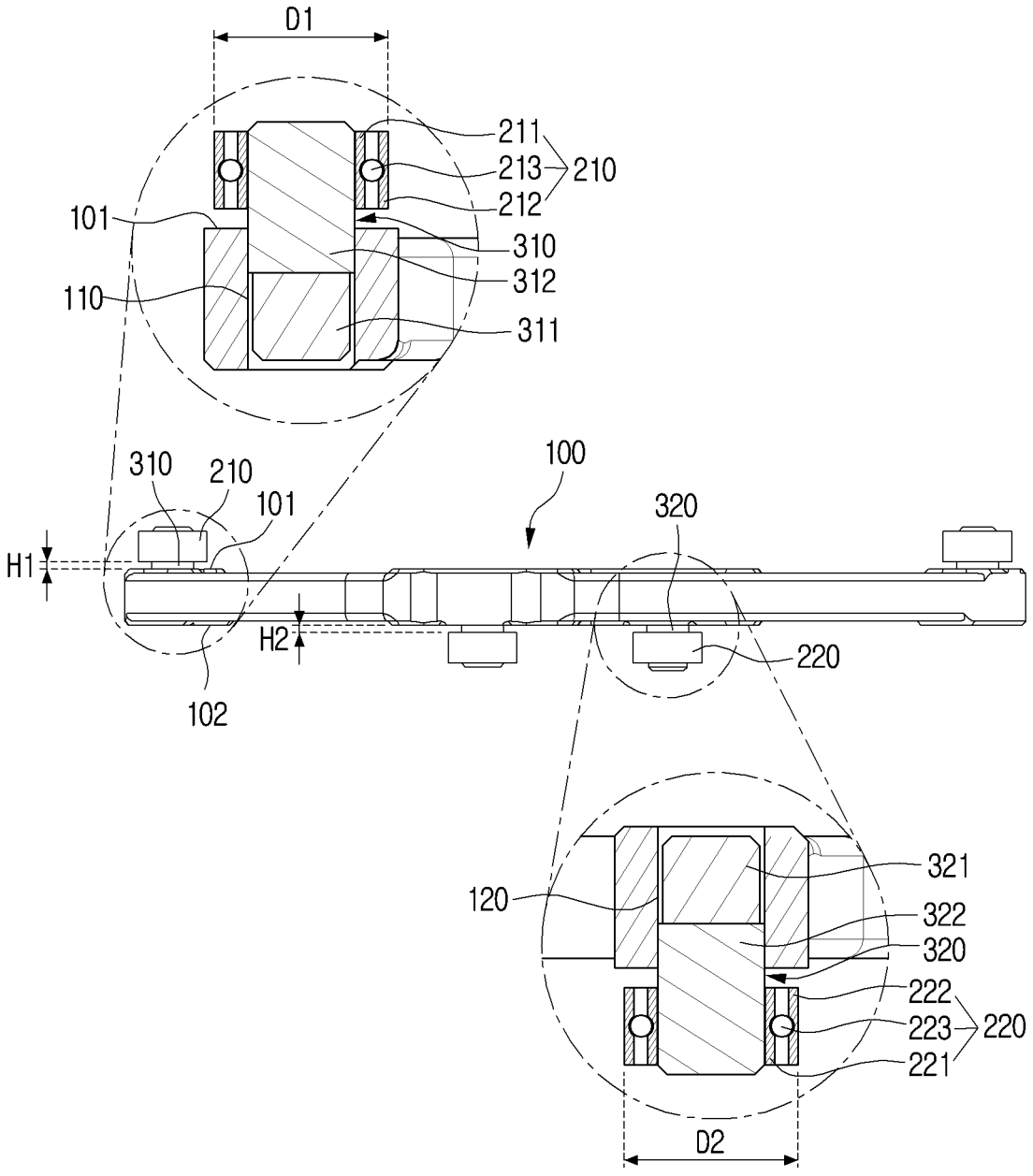
FIG. 6 is a diagram for describing a coupling structure of the guide member and the bearing member.

FIG. 3 is an exploded perspective view illustrating a structure in which the bearing member is disposed in the receiving groove of the frame. FIG. 4 is an exploded perspective view for describing a structure in which the bearing member is disposed in the receiving groove of the orbiting scroll. FIG. 5 is an exploded perspective view of the guide member and the bearing member. FIG. 6 is a diagram for describing a coupling structure of the guide member and the bearing member.

Referring to FIGS. 3 to 6, the orbiting scroll 50 may include an orbiting wrap 53 disposed on one surface 52*a* facing the fixed scroll 40 and a first receiving groove 56 formed on the other surface 52*b*. The orbiting wrap 53 may form a compression chamber together with the fixed wrap 43 of the fixed scroll 40.

The frame 20 may include a second receiving groove 24 formed on one surface 20*a* facing the other surface 52*b* of the orbiting scroll 50.

The guide member 100 may be disposed between the orbiting scroll 50 and the frame 20 to prevent the orbiting scroll 50 from rotating.

The scroll compressor 1 may include a plurality of bearing members 200. The plurality of bearing members 200 may include inner rings 211 and 221 that are disposed in at least one of the first receiving groove 56 and the second receiving groove 24 and fixed to the guide member 100. For example, some bearing members of the plurality of bearing members 200 may be disposed in the first receiving groove 56, and other bearing members of the plurality of bearing members 200 may be disposed in the second receiving groove 24, with the inner ring of each bearing member being fixed to the guide member 100.

The bearing member 200 may be a ball bearing or a roller bearing as a rolling bearing, but the type of the bearing member 200 is not limited thereto.

As the bearing member 200 is inserted into the first receiving groove 56 and the second receiving groove 24, the guide member 100 may relatively move only in a longitudinal direction of the second receiving groove 24 with respect to the frame 20, and the orbiting scroll 50 may relatively move only in a longitudinal direction of the first receiving groove 56 with respect to the guide member 100. That is, since the orbiting scroll 50 is restricted in a movement direction in a specific direction with respect to the frame 20, the guide member 100 and the bearing member 200 may prevent the orbiting scroll 50 from rotating.

In addition, since rolling friction occurs between the guide member 100 and the frame 20 and between the guide member 100 and the orbiting scroll 50, the friction loss occurring between the guide member 100, the frame 20, and the orbiting scroll 50 may be minimized, and the compression efficiency of the scroll compressor 1 may be increased.

The scroll compressor 1 may include a plurality of pin members 300. The pin member 300 may have a substantially cylindrical shape. The plurality of pin members 300 may include one end 311 and 321 fixed to the guide member 100, and the other ends 312 and 322 fixed to each inner ring 211 and 221 of the plurality of bearing members 200.

The guide member 100 may include a plurality of insertion holes 110 and 120 each formed at locations corresponding to the plurality of bearing members 200. One end 311 and 321 of the plurality of pin members 300 may each be inserted into the plurality of insertion holes 110 and 120.

The inner rings 211 and 221 of the plurality of bearing members 200 may surround the other ends 312 and 322 of the plurality of pin members 300, respectively.

The plurality of bearing members 200 may include a first bearing member 210 and a second bearing member 220.

The first bearing member 210 may include an outer ring 212 spaced apart from one surface 101 facing the orbiting scroll 50 of the guide member 100, and may be disposed in the first receiving groove 56 of the orbiting scroll 50.

The second bearing member 220 may include an outer ring 222 spaced apart from the other surface 102 facing the frame 20 of the guide member 100, and may be disposed in the second receiving groove 24 of the frame 20.

A lower surface of the outer ring 212 of the first bearing member 210 may be disposed above the one surface 101 of the guide member 100 by a length of H1.

An upper surface of the outer ring 222 of the second bearing member 220 may be disposed below the other surface 102 of the guide member 100 by a length of H2.

Accordingly, the outer ring 212 of the first bearing member 210 may freely rotate in contact with the inner surface of the first receiving groove 56 without interfering with the guide member 100, and the outer ring 222 of the second bearing member 220 may freely rotate in contact with the inner surface of the second receiving groove 24 without interfering with the guide member 100.

Meanwhile, the inner rings 211 and 221 of the first and second bearing members 210 and 220 may be fixed to the guide member 100 and may move integrally with the guide member 100.

The first and second bearing members 210 and 220 may have a cylindrical shape. The inner rings 211 and 221 and the outer rings 212 and 222 of the first and second bearing members 210 and 220 may have an annular ring shape having the same central axis.

The first bearing member 210 may include a pair of first bearing members 210 disposed on a first line L1 extending along the radial direction of the guide member 100.

The second bearing member 220 may include a pair of second bearing members 220 disposed on a second line L2 orthogonal to the first line L1 extending along the radial direction of the guide member 100.

The plurality of pin members 300 may include a pair of first pin members 310 and a pair of second pin members 320.

The pair of first pin members 310 may include one end 311 fixed to the guide member 100, and the other end 312 fixed to each inner ring 211 of the pair of first bearing members 210.

The guide member 100 may include the pair of insertion holes 110 each formed at locations corresponding to the pair of first bearing members 210. One end 311 of the pair of first pin members 310 may each be inserted into the pair of first insertion holes 110.

The pair of second pin members 320 may include one end 321 fixed to the guide member 100, and the other end 322 fixed to each inner ring 221 of the pair of second bearing members 220.

The guide member 100 may include the pair of second insertion holes 120 each formed at locations corresponding to the pair of second bearing members 220. One end 321 of the pair of second pin members 320 may each be inserted into the pair of second insertion holes 120.

The pair of first bearing members 210 may be located at the same distance from the center of the guide member 100. The pair of second bearing members 220 may be located at the same distance from the center of the guide member 100.

For example, the guide member 100 may have a circular ring shape, and the pair of first bearing members 210 and the pair of second bearing members 220 may be connected to the guide member 100.

The outer ring 212 of the first bearing member 210 may be in contact with the inner surface of the first receiving groove 56. The outer ring 222 of the second bearing member 220 may be in contact with the inner surface of the second receiving groove 24.

Accordingly, when the guide member 100 and the orbiting scroll 50 relatively move with respect to each other, the outer ring 212 of the first bearing member 210 may rotate in contact with the inner surface of the first receiving groove 56. In addition, when the guide member 100 and the frame 20 relatively move with respect to each other, the outer ring 222 of the second bearing member 222 may rotate in contact with the inner surface of the second receiving groove 24.

The first receiving groove 56 may be formed to extend in the radial direction of the orbiting scroll 50. The second receiving groove 24 may be formed to extend in the radial direction of the frame 20.

The second bearing member 220 may move along the extending direction of the second receiving groove 24 while being inserted into the second receiving groove 24, and the guide member 100 may also relatively move with respect to the frame 20 along the extending direction of the second receiving groove 24.

The first bearing member 210 may move along the extending direction of the first receiving groove 56 while being inserted into the first receiving groove 56, and the guide member 100 may also relatively move with respect to the guide member 100 integrally formed with the first bearing member 210 along the extending direction of the second receiving groove 24.

Accordingly, since the direction of movement of the orbiting scroll 50 is determined only by the extending directions of the first receiving groove 56 and the second receiving groove 24 with respect to the fixed frame 20, the orbiting scroll 50 may stably orbit without rotating. The extending direction of the first receiving groove 56 and the extending direction of the second receiving groove 24 may be orthogonal to each other.

One end of the first receiving groove 56 and the second receiving groove 24 may have a curved shape engaged with the outer rings 212 and 222 of the plurality of bearing members 200.

One end of the first receiving groove 56 may have a curved shape engaged with the outer ring 212 of the first bearing member 210. The other end of the first receiving groove 56 may be opened to the outside of the orbiting scroll 50.

One end of the second receiving groove 24 may have a curved shape engaged with the outer ring 222 of the second bearing member 220. The other end of the second receiving groove 24 may have a curved shape engaged with the outer ring 222 of the second bearing member 220.

Accordingly, even when the bearing member 200 moves to the end of the first receiving groove 56 or the second receiving groove 24, the bearing member 200 may minimize the friction loss due to the collision with the first and second receiving grooves 56 and 24 without being damaged.

The plurality of bearing members 200 may each include a plurality of rolling members 213 and 223 disposed between the outer rings 212 and 222 and the inner rings 211 and 221.

The first bearing member 210 may include the plurality of rolling members 213 disposed between the outer ring 212 and the inner ring 211. The second bearing member 220 may include the plurality of rolling members 223 disposed between the outer ring 222 and the inner ring 221.

The rolling members 213 and 223 may be balls or rollers having a spherical shape, but a type thereof is not limited thereto. Accordingly, the outer rings 212 and 222 and the inner rings 211 and 221 of the bearing member 200 may relatively move to each other.

Therefore, since the rolling friction occurs between the guide member 100 and the frame 20 and between the guide member 100 and the orbiting scroll 50, the friction loss occurring between the guide member 100, the frame 20, and the orbiting scroll 50 may be minimized, and the compression efficiency of the scroll compressor 1 may be increased.

The outer rings 212 and 222 of the plurality of bearing members 200 may have diameters smaller than or equal to widths of the first receiving groove 56 and the second receiving groove 24.

The outer ring 212 of the first bearing member 210 may have a diameter D1 smaller than or equal to the width of the first receiving groove 56. The outer ring 222 of the second bearing member 220 may have a diameter D2 smaller than or equal to the width of the second receiving groove 24.

Accordingly, the first bearing member 210 may be inserted into the inner space of the first receiving groove 56, and the second bearing member 220 may be inserted into the inner space of the second receiving groove 24.

The frame 20 includes an outer wall 29 to which the fixed scroll 40 is fixed, an inner wall 26 supporting the orbiting scroll 50 and surrounded by the guide member 100, and the concave recess 28 disposed between the outer wall 29 and the inner wall 26.

The fixed scroll 40 may be fixed to the outer wall 29 of the frame 20 and fixedly disposed inside the housing 10 together with the frame 20.

The guide member 100 has an annular ring phenomenon and may be disposed in the recess 28 of the frame 20. One surface 20*a* of the frame 20 on which the second receiving groove 24 of the frame 20 is formed may define the lower portion of the recess 28. The second receiving groove 24 and the recess 28 may communicate with each other.

The inner wall 26 of the frame 20 may include a groove 26*a* formed by extending the second receiving groove 24. The outer wall 29 of the frame 20 may include a groove 29*a* formed by extending the second receiving groove 24.

The groove 26*a* of the inner wall 26 and the groove 29*a* of the outer wall 29 may have a concave curved shape engaged with the outer ring 222 of the second bearing member 220.

Accordingly, even when the second bearing member 220 moves to the end of the second receiving groove 24, the second bearing member 220 may minimize the friction loss due to collision with the inner wall 26 and the outer wall 29 of the frame 20 without being damaged.

Although exemplary embodiments of the present disclosure have been illustrated and described hereinabove, the present disclosure is not limited thereto, but may be variously modified by those skilled in the art to which the present disclosure pertains without departing from the spirit and scope of the present disclosure claimed in the claims. These modifications are to fall within the scope of the present disclosure.

What is claimed is:

1. A scroll compressor, comprising:

a housing;

a fixed scroll fixed to an inside of the housing and including a fixed wrap;

an orbiting scroll including an orbiting wrap disposed on a first surface of the orbiting scroll facing the fixed scroll to form a compression chamber together with the fixed wrap, and a first receiving groove formed on a second surface, opposite to the first surface, of the orbiting scroll;

a frame fixed to the inside of the housing and including a second receiving groove formed on a surface of the frame facing the second surface of the orbiting scroll and forming a ring-shaped back pressure chamber disposed inside the frame and between the second surface of the orbiting scroll and the surface of the frame;

a guide ring disposed in the ring-shaped back pressure chamber between the orbiting scroll and the frame; and a plurality of roller bearings, each including an inner ring fixed to the guide ring, wherein some of the plurality of roller bearings are disposed in the first receiving groove and others of the plurality of roller bearings are disposed in the second receiving groove, and the guide ring and the plurality of roller bearings prevent the orbiting scroll from rotating.

2. The scroll compressor of claim 1, further comprising:

a plurality of pins corresponding, respectively, to the plurality of roller bearings, wherein a first end of each pin of the plurality of pins is fixed to the guide ring and a second end of each pin is fixed to the inner ring of a corresponding roller bearing of the plurality of roller bearings.

3. The scroll compressor of claim 2, wherein the guide ring includes a plurality of insertion holes formed at locations corresponding, respectively, to the plurality of roller bearings, and the first end of each pin of the plurality of pins is inserted into an insertion hole of the plurality of insertion holes that corresponds to a roller bearing of the plurality of roller bearings to which the each pin corresponds.

4. The scroll compressor of claim 2, wherein the inner ring of each roller bearing of the plurality of roller bearings surrounds the second end of each pin that corresponds to the corresponding roller bearing of the plurality of roller bearings.

5. The scroll compressor of claim 1, wherein the plurality of roller bearings include:

a first roller bearing disposed in the first receiving groove and including an outer ring spaced apart from a surface of the guide ring facing the orbiting scroll; and a second roller bearing disposed in the second receiving groove and including an outer ring spaced apart from a surface of the guide ring facing the frame.

6. The scroll compressor of claim 5, wherein the first roller bearing includes a pair of first roller bearings disposed on a first line extending along a radial direction of the guide ring, and the second roller bearing includes a pair of second roller bearings extending along a radial direction of the guide ring and disposed on a second line orthogonal to the first line.

7. The scroll compressor of claim 6, wherein each first roller bearing of the pair of first roller bearings is located at an equal distance from a center of the guide ring, and each second roller bearing of the pair of second roller bearings is located at the equal distance from the center of the guide ring.

8. The scroll compressor of claim 5, wherein the outer ring of the first roller bearing is in contact with an inner surface of the first receiving groove, and the outer ring of the second roller bearing is in contact with an inner surface of the second receiving groove.

9. The scroll compressor of claim 1, wherein the first receiving groove extends in a radial direction of the orbiting scroll, and the second receiving groove extends in a radial direction of the frame.

10. The scroll compressor of claim 1, wherein each roller bearing of the plurality of roller bearings include an outer ring, one end of the first receiving groove has a curved shape engaged with the outer ring of each roller bearing of the plurality of roller bearings disposed in the first receiving groove, and one end of the second receiving groove has a curved shape engaged with the outer ring of each roller bearing of the plurality of roller bearings disposed in the second receiving groove.

11. The scroll compressor of claim 1, wherein each roller bearing of the plurality of roller bearings include an outer ring and a plurality of rolling members disposed between the outer ring and the inner ring.

12. The scroll compressor of claim 1, wherein the frame includes an outer wall to which the fixed scroll is fixed, an inner wall supporting the orbiting scroll and surrounded by the guide ring, and the ring-shaped back pressure chamber is formed between the outer wall and the inner wall, and the inner wall of the frame includes a groove formed by extending the second receiving groove.

13. A home appliance that controls temperature through heat exchange using a refrigerant, the home appliance comprising:

a scroll compressor configured to compress the refrigerant, the scroll compressor including:

a housing;

a fixed scroll fixed to an inside of the housing and include a fixed wrap;

an orbiting scroll including an orbiting wrap disposed on a first surface of the orbiting scroll facing the fixed scroll to form a compression chamber together with the fixed wrap, and a first receiving groove formed on a second surface, opposite to the first surface, of the orbiting scroll;

a frame fixed to the inside of the housing and including a second receiving groove formed on a surface of the frame facing the second surface of the orbiting scroll and forming a ring-shaped back pressure chamber disposed inside the frame and between the second surface of the orbiting scroll and the surface of the frame a guide ring disposed in the ring-shaped back pressure chamber between the orbiting scroll and the frame;

at least one roller bearing disposed in the first receiving groove and including an inner ring fixed to the guide ring; and at least one roller bearing disposed in the second receiving groove and including an inner ring fixed to the guide ring, wherein the guide ring, the at least one roller bearing disposed in the first receiving groove, and the at least one roller bearing disposed in the second receiving groove prevent the orbiting scroll from rotating.

14. The home appliance of claim 13, wherein the home appliance is one of an air conditioner, a refrigerator, and a freezer.

15. A scroll compressor, comprising:

a housing;

a fixed scroll fixed to an inside of the housing and including a fixed wrap;

an orbiting scroll including an orbiting wrap disposed on a first surface of the orbiting scroll facing the fixed scroll to form a compression chamber together with the fixed wrap, and a first receiving groove formed on a second surface, opposite to the first surface, of the orbiting scroll;

a frame fixed to the inside of the housing and including a second receiving groove formed on a surface of the frame facing the second surface of the orbiting scroll and forming a ring-shaped back pressure chamber disposed inside the frame and between the second surface of the orbiting scroll and the surface of the frame;

a guide ring disposed in the ring-shaped back pressure chamber between the orbiting scroll and the frame;

a roller bearing disposed in the first receiving groove and including an inner ring fixed to the guide ring; and a roller bearing disposed in the second receiving groove and including an inner ring fixed to the guide ring, wherein the guide ring, the roller bearing disposed in the first receiving groove, and the roller bearing disposed in the second receiving groove prevent the orbiting scroll from rotating.

16. The scroll compressor of claim 15, further comprising:

a first pin having a first end fixed to the guide ring and a second end fixed to the inner ring of the roller bearing disposed in the first receiving groove, and a second pin having a first end fixed to the guide ring and a second end fixed to the inner ring of the roller bearing disposed in the second receiving groove.

17. The scroll compressor of claim 16, wherein the inner ring of the roller bearing disposed in the first receiving groove surrounds the second end of the first pin, and the inner ring of the roller bearing disposed in the second receiving groove surrounds the second end of the second pin.

18. The scroll compressor of claim 16, wherein the guide ring includes first insertion hole formed at a location corresponding to the roller bearing disposed in the first receiving groove, and a second insertion hole formed at a location corresponding the roller bearing disposed in the second receiving groove, and the first end of the first pin is inserted into the first insertion hole, and the first end of the second pin is inserted into the second insertion hole.

* * * * *